US011920331B2

(12) United States Patent
Appler

(10) Patent No.: US 11,920,331 B2
(45) Date of Patent: Mar. 5, 2024

(54) CONFIGURABLE COLLABORATIVE COMMUNAL CULINARY WORKSPACES

(71) Applicant: Jason Alan Appler, Monterey, CA (US)

(72) Inventor: Jason Alan Appler, Monterey, CA (US)

( * ) Notice: Subject to any disclaimer, the term of this patent is extended or adjusted under 35 U.S.C. 154(b) by 0 days.

(21) Appl. No.: 18/154,013

(22) Filed: Jan. 12, 2023

(65) Prior Publication Data

US 2023/0250620 A1 Aug. 10, 2023

Related U.S. Application Data

(63) Continuation of application No. 17/160,277, filed on Jan. 27, 2021, now Pat. No. 11,578,477.

(60) Provisional application No. 62/968,119, filed on Jan. 30, 2020.

(51) Int. Cl.

| | |
|---|---|
| ***E03C 1/05*** | (2006.01) |
| ***A47B 77/14*** | (2006.01) |
| ***A47B 96/18*** | (2006.01) |
| ***A47L 17/02*** | (2006.01) |
| ***A47L 19/04*** | (2006.01) |

(52) U.S. Cl.

CPC ..... *E03C 1/057* (2013.01); *A47B 77/14* (2013.01); *A47B 96/18* (2013.01); *A47L 17/02* (2013.01); *A47L 19/04* (2013.01)

(58) Field of Classification Search

CPC ..... E03C 1/057; A47B 77/14; A47B 96/18; A47B 77/06; A47L 17/02; A47L 19/04

USPC ..... 4/638, 619, 628, 629, 630, 631, 653; 312/228, 210

See application file for complete search history.

(56) References Cited

U.S. PATENT DOCUMENTS

| | | | |
|---|---|---|---|
| 2,178,411 | A | 10/1939 | Tietz |
| 2,314,157 | A | 3/1943 | O'Brien |
| 2,498,502 | A | 2/1950 | O'Brien |
| 4,305,166 | A | 12/1981 | Rose |
| 4,621,588 | A | 11/1986 | Harris |
| 4,935,991 | A | 6/1990 | Tourney |
| 5,073,997 | A | 12/1991 | Rabe |
| 5,313,676 | A | 5/1994 | Wright |
| 5,522,411 | A | 6/1996 | Johnson |
| 5,702,115 | A | 12/1997 | Pool |
| 5,815,855 | A | 10/1998 | McKeehan |
| 5,819,335 | A | 10/1998 | Hennessy |
| 5,915,851 | A | 6/1999 | Wattrick |

(Continued)

FOREIGN PATENT DOCUMENTS

| | | | |
|---|---|---|---|
| EP | 3243966 | A1 * | 11/2017 |
| WO | WO-2009039290 | A2 * | 3/2009 |

(Continued)

*Primary Examiner* — Lori L Baker
(74) *Attorney, Agent, or Firm* — Kang S. Lim

(57) ABSTRACT

An off-counter tableware, cookware or utensils drying/storage space includes a mix of drawers and/or shelves distributed in upper and/or lower locations. The drawers and shelves allow water to evaporate off tableware, cookware or utensil which have been cleaned and placed in the drawer/shelf wet and also direct any water which does not evaporate to a collection point. In addition, a communal washing and/or rinsing station includes a primary washing and rinsing device with a default-spray nozzle. The station can include a high flow filling device and a filtered water faucet.

8 Claims, 24 Drawing Sheets

(56) References Cited

U.S. PATENT DOCUMENTS

| | | | | |
|---|---|---|---|---|
| 6,427,259 | B1 | 8/2002 | Cawthon | |
| 8,549,871 | B1 | 10/2013 | Lauchnor | |
| 10,925,188 | B1 | 2/2021 | Keehn | |
| 11,578,477 | B2 * | 2/2023 | Appler | E03C 1/057 |
| 2002/0184704 | A1 | 12/2002 | Cawthon | |
| 2004/0093667 | A1 * | 5/2004 | Erickson | E03C 1/18 4/631 |
| 2007/0033730 | A1 * | 2/2007 | Bean | A47D 5/00 4/619 |
| 2007/0157978 | A1 * | 7/2007 | Jonte | E03C 1/057 137/613 |
| 2009/0056011 | A1 * | 3/2009 | Wolf | E03C 1/057 4/623 |
| 2009/0077736 | A1 * | 3/2009 | Loberger | E03C 1/01 4/619 |
| 2009/0113619 | A1 | 5/2009 | Tichenor | |
| 2009/0139023 | A1 * | 6/2009 | Talerico | E03C 1/186 4/654 |
| 2011/0271441 | A1 * | 11/2011 | Bayley | A47K 1/04 4/638 |
| 2012/0084911 | A1 * | 4/2012 | Kim | F16L 25/08 4/619 |
| 2015/0259890 | A1 * | 9/2015 | Shirai | G01S 7/4815 250/221 |
| 2016/0186417 | A1 | 6/2016 | Paternoster | |
| 2016/0198909 | A1 | 7/2016 | Bayley | |
| 2016/0206176 | A1 | 7/2016 | Eilmus | |
| 2017/0328048 | A1 * | 11/2017 | Karei | G01J 1/0429 |
| 2017/0356173 | A1 * | 12/2017 | Loberger | E03C 1/0404 |
| 2018/0259202 | A1 | 9/2018 | Kim | |
| 2019/0029473 | A1 | 1/2019 | Bauer | |
| 2019/0032312 | A1 * | 1/2019 | Loberger | A47K 5/12 |
| 2020/0237182 | A1 | 7/2020 | Klug | |
| 2021/0235865 | A1 * | 8/2021 | Appler | A47B 77/14 |
| 2021/0348836 | A1 | 11/2021 | Lauchnor | |
| 2022/0025620 | A1 * | 1/2022 | Eilmus | E03C 1/182 |
| 2022/0081885 | A1 | 3/2022 | Leighton | |

FOREIGN PATENT DOCUMENTS

| | | | |
|---|---|---|---|
| WO | WO-2010147297 | A2 * | 12/2010 |
| WO | WO-2011044247 | A1 * | 4/2011 |
| WO | WO-2014050225 | A1 * | 4/2014 |

* cited by examiner

300

300

700B

700C

700E

CONFIGURABLE COLLABORATIVE COMMUNAL CULINARY WORKSPACES

CROSS-REFERENCE TO RELATED APPLICATION

This is a Continuation application and claims the benefit and priority of U.S. non-Provisional application Ser. No. 17/160,277, filed Jan. 27, 2021 entitle "CONFIGURABLE collaborative communal culinary workSPACES", which claims the benefit and priority of U.S. Provisional Application No. 62/968,119, filed Jan. 30, 2020, which is are incorporated herein in its their entirety by this reference.

BACKGROUND

The present invention relates to systems and methods for intelligently and efficiently configuring and supporting communal culinary workspaces shared by multiple residents.

In many large cities, the cost of housing has grown at an astounding rate, while real income has fallen, and the percentage of income spent on housing has increased to over 40% of income for many urban residents. This creates a hardship for many in affording housing in their city. For example, almost 42% of adults in San Francisco manage the high cost of shelter by living with multiple housemates out of necessity. Immersion research and surveys identified frustrations that this group experiences with the cleaning and storage of dish and cookware in shared kitchens, as well as inadequacies in products available to address their collective needs. Interviews with industry representatives indicate a mismatch between these customers who share their residence, and the idealized home-maker customer who the kitchen product industry generally designs for. This mismatch can best be summarized as the shared kitchen needing to support multiple independent cook cycles, while the current industry focus is one cook cycle family kitchen. Cook cycle is defined here as the preparation and cleaning up after a meal or daily set of meals.

It is therefore apparent that an urgent need exists to adapt single family home kitchens to collaborative communal culinary workspaces. These improved culinary workspaces enable multiple residents to efficiently store and prepare food within such workspaces with limited footprint, while practicing good environmental stewardship.

SUMMARY

To achieve the foregoing and in accordance with the present invention, systems and methods for making the kitchen efficient for multiple cook-cycle homes is provided. In particular the systems and methods for managing tableware, cookware, and counter space.

In one embodiment, an off-counter space for drying and storing tableware, cookware and/or utensils is provided. The drying/storage space can include a mix of drawer(s) and/or shelve(s) distributed in one or more casings, which can in turn can be located in lower and/or upper location(s) in, for example, a typical kitchen and/or pantry. The drawer(s) and/or shelve(s) are designed and constructed in a manner allowing water to evaporate off tableware, cookware or utensil which have been cleaned and placed in a drawer or shelf wet and also directs any water which does not evaporate to a collection point which allows for the drainage or reclamation of the water in a manner that prevents residential water damage.

In another embodiment, a communal washing and/or rinsing station includes a primary washing and rinsing device with a nozzle which defaults to spray as its primary mode. An indexed controller operatively coupled to the primary washing and rinsing device, wherein the controller limits a user to a pre-determined selection of water temperature or flow rate, and therefore spends less time and effort initiating the washing and rinsing device, thereby saving time, effort, and water. The station can also include a high flow filling device for reduce the effort and time required to fill pots and other items with filtered water. A filtered water faucet can be coupled to the filing device.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "always," "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

Figure 1:
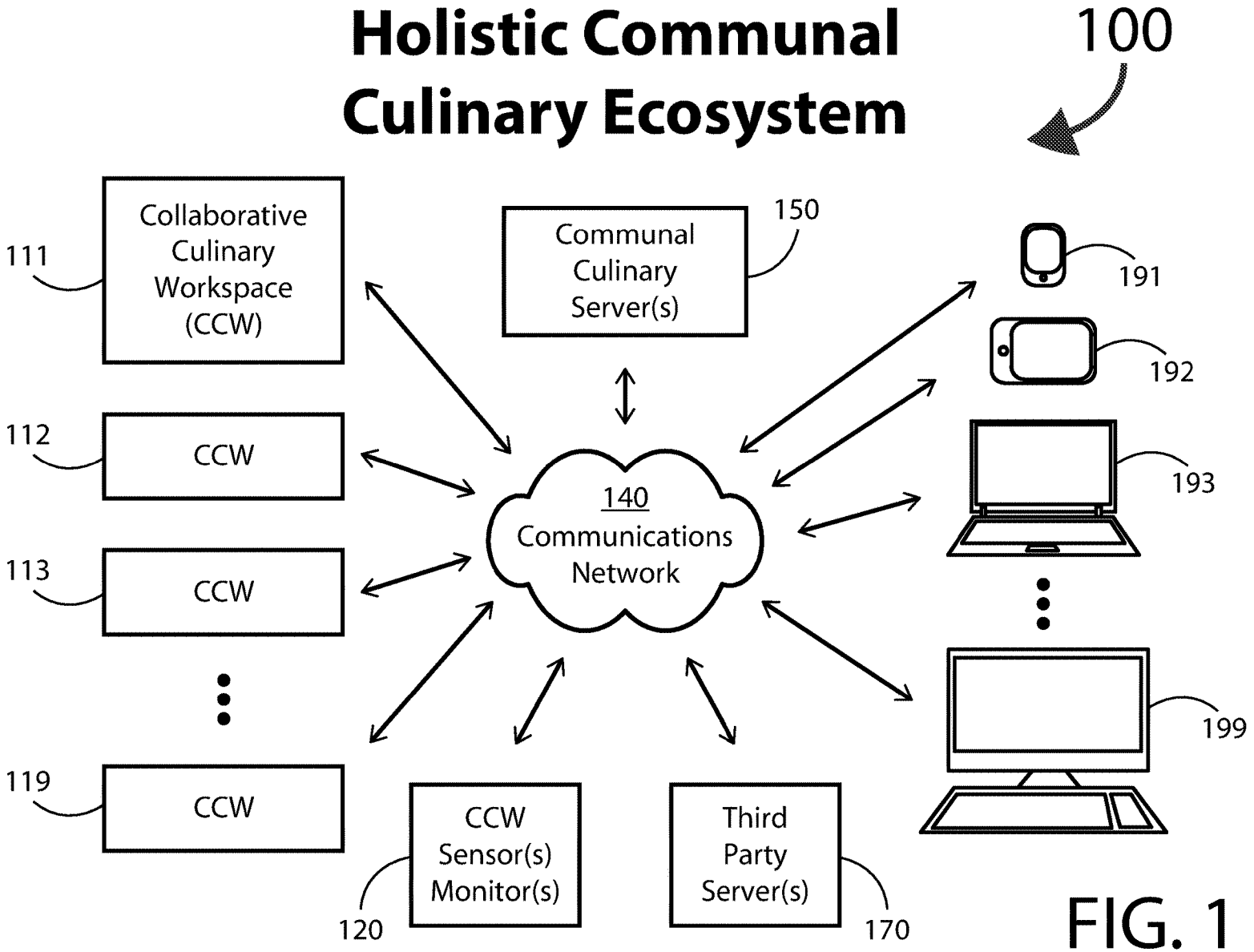
FIG. 1 is a block diagram of an exemplary environmentally-friendly communal culinary ecosystem having one or more of the collaborative culinary; workspaces shared by a plurality of co-residents in accordance with the present invention.

To facilitate discussion, FIG. 1 is a block diagram illustrating an environmentally-friendly communal culinary ecosystem 100 having one or more of the collaborative culinary workspaces ("CCW(s)" or "CC workspace(s)") 111, 112, 113 . . . 119 shared by a plurality of residents in accordance with the present invention.

Figure 2:
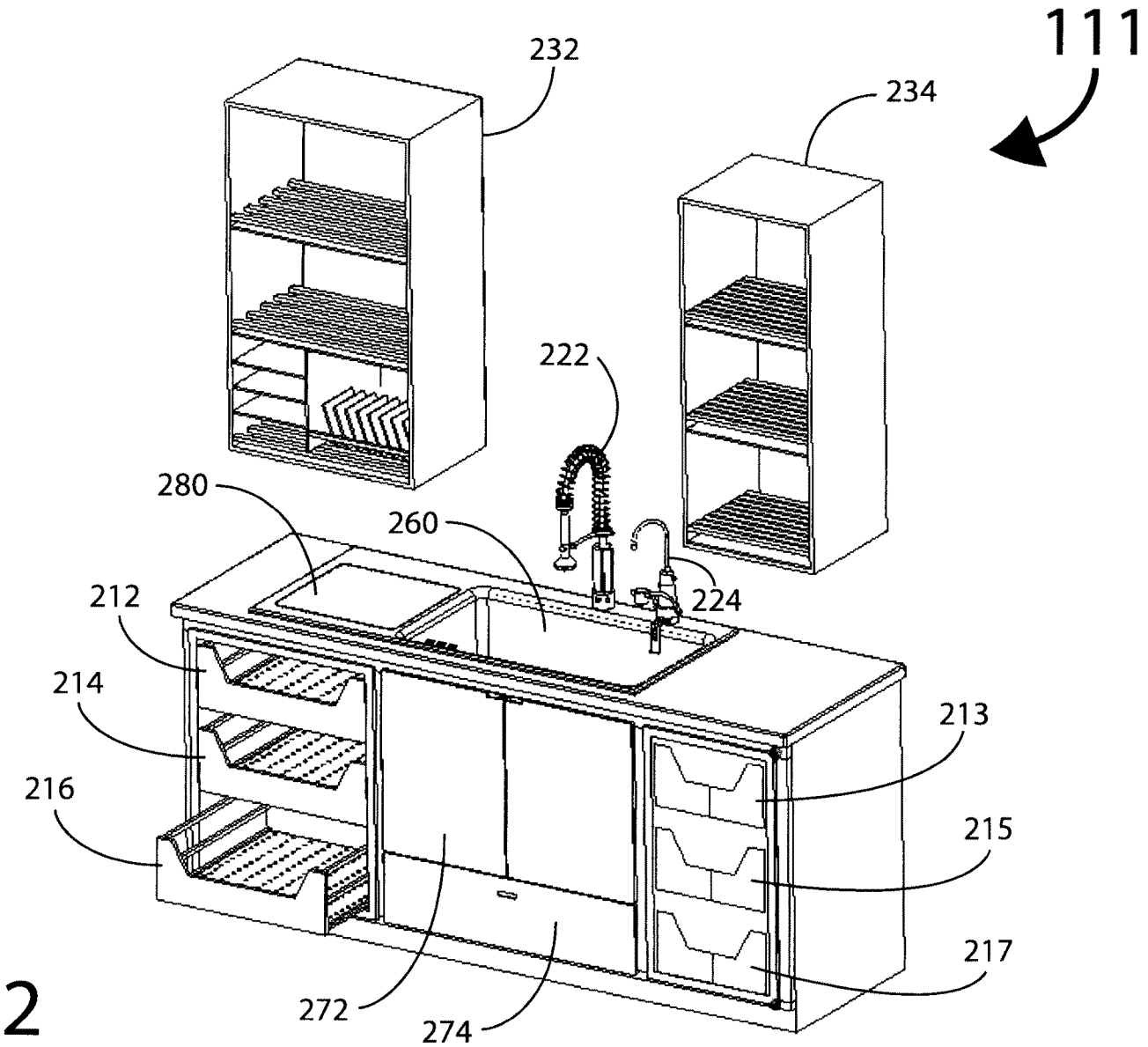
FIG. 2 depicts one embodiment of a customizable collaborative culinary workspace ("CCW") for the communal culinary ecosystem of FIG. 1.

FIG. 2 depicts an ideation of one embodiment of the configurable collaborative communal culinary workspace 111 including a plurality of drying/storage drawer(s) 212, 213, 214, 215, 216 & 217, washing/rinsing devices 222 & 224, optional storage spaces 232 & 234, a wash basin 260 and a food preparation surface 280. Workspace fronts 272 & 274 conceal storage spaces under the wash basin 260.

Figure 3A:
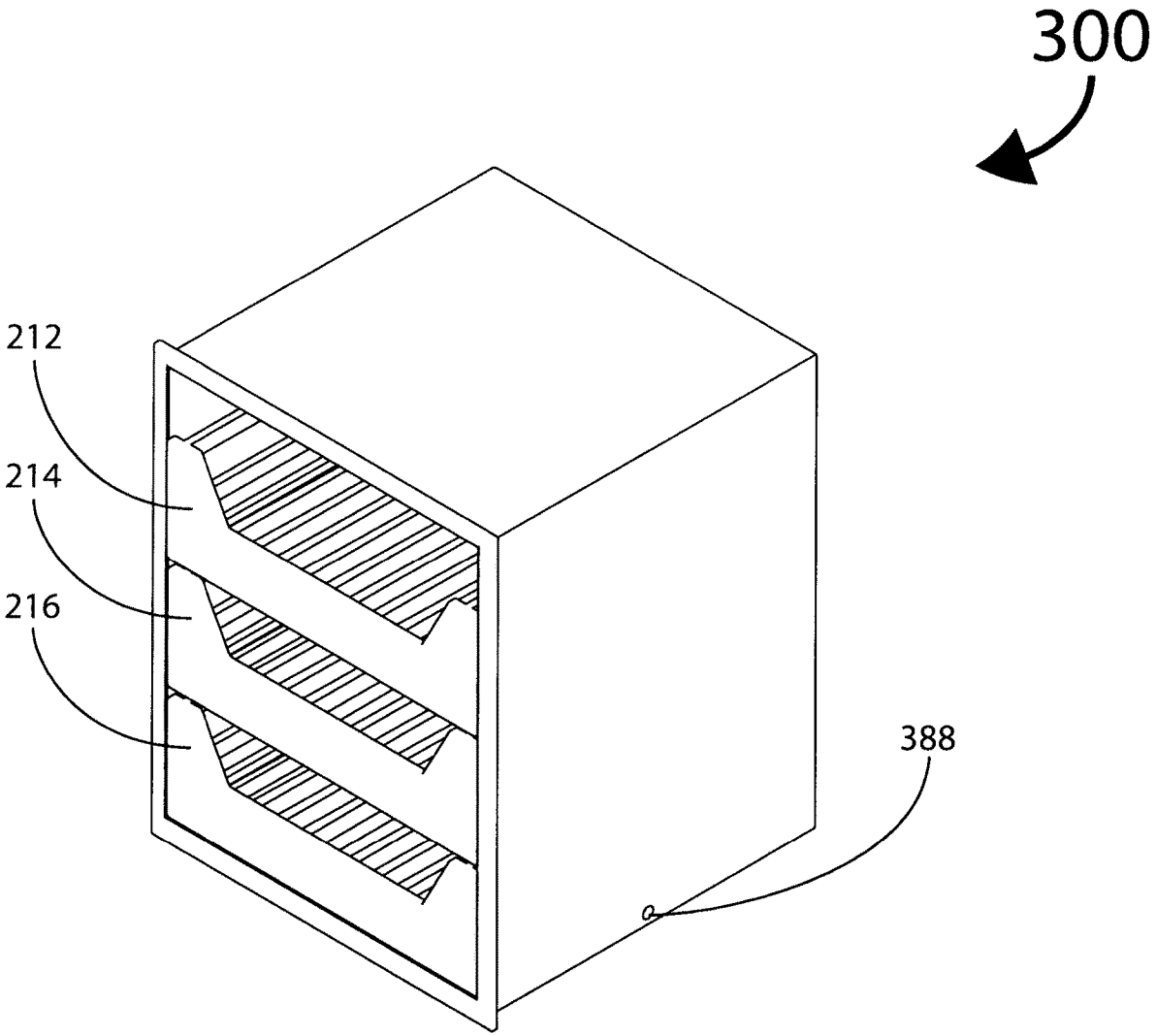
FIGS. 3A-3C illustrate a plurality of drying/storage drawers for the collaborative culinary workspace of FIG. 2.
Figure 3B:
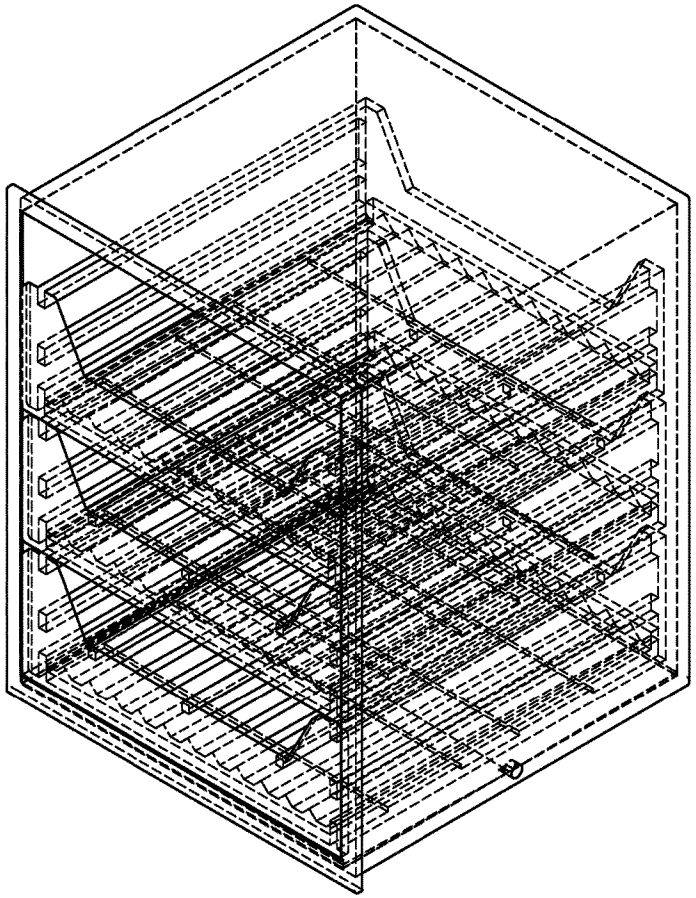
Figure 3C:
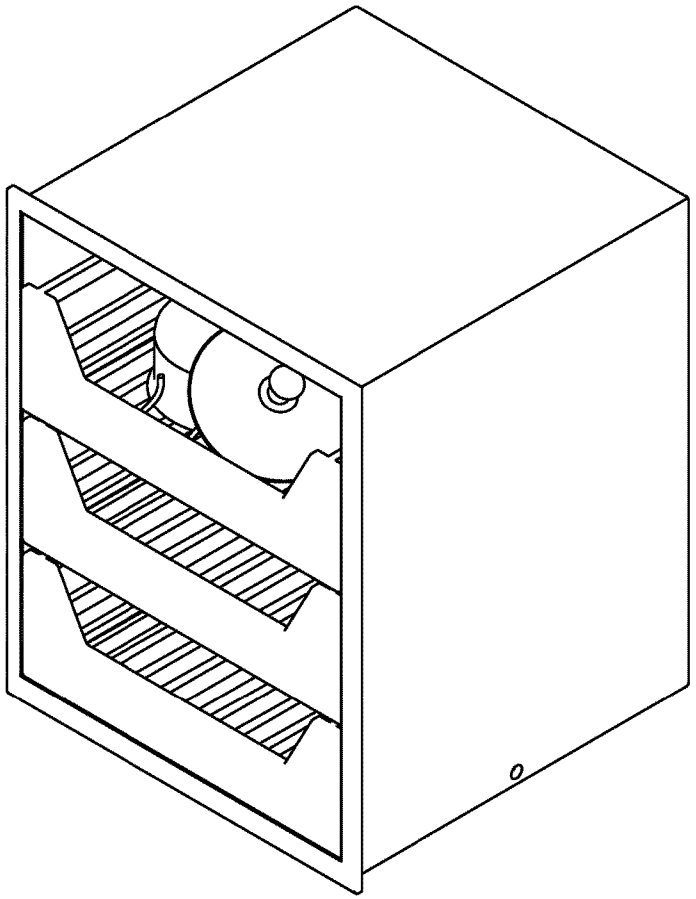

Referring now to FIGS. 3A-3C which illustrates an exemplary drying/storage space 300, which in this embodiment is sized to fit the standard cabinet opening for an automatic dishwasher, and includes drawers 212, 214 & 216, while FIGS. 4A-4D illustrate drawer 212 with greater details and optional inserts. Drawer 212 includes a drawer bottom 480 and drawer sides 442, 444, 446 & 448. Drawer 212 can be attached to drying/storage space 300 via drawer slide components 472 & 474. Storage space 300 can also include a drainage port 388.

Figure 5A:
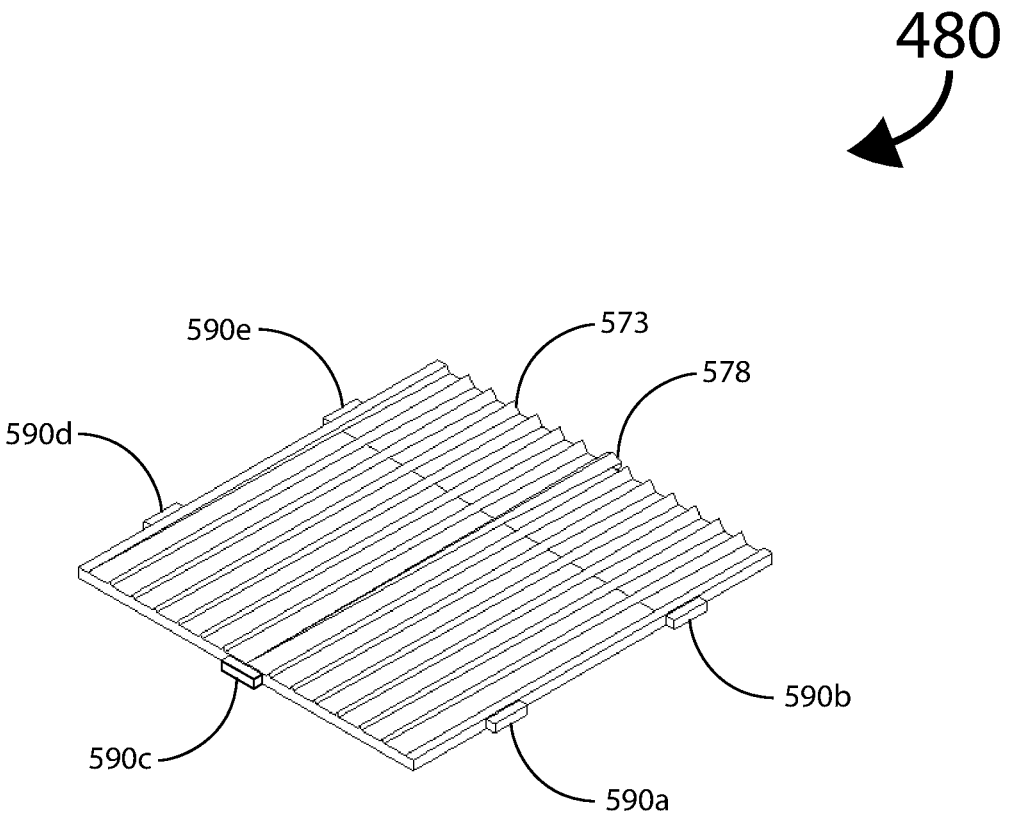
FIG. 5A depicts a detachable drawer platform for the drawer of FIG. 4A.
Figure 5B:
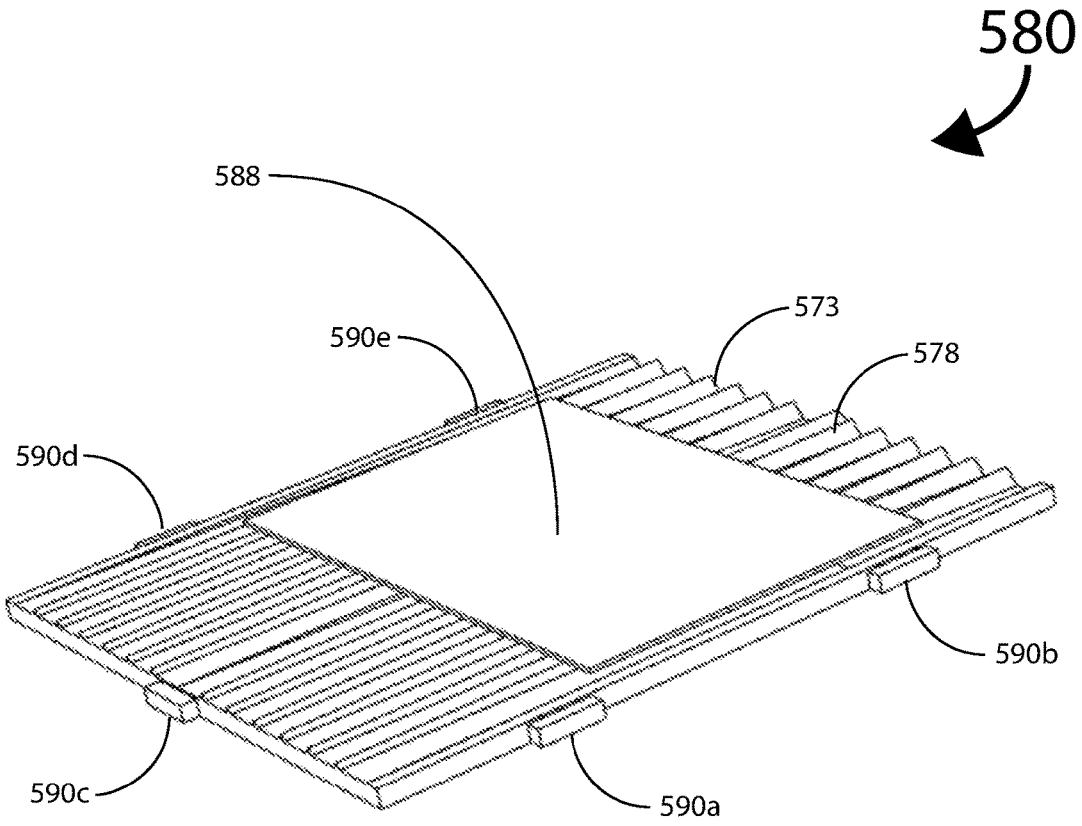
FIG. 5B depicts another embodiment of a detachable drawer platform with a wicking mat.

As shown in FIG. 5A, in this embodiment, drawer bottom 480 includes locking tabs 590*a*, 590*b*, 590*c*, 590*d* & 590*e* for securing bottom 480 to a drawer front 446, drawer sides 444, 448 and drawer back 442. The structure of drawer 212 can be skeletonized to maximize air flow and visibility. FIG. 5B illustrates a variation of drawer bottom 580 which also include a wicking mat 588.

Drawer sides 444, 448, front 446 and back 442 can be made from suitable water-resistant and/or antimicrobial materials such as recycled/recyclable plastics, corrosion resistant metals and metal alloys, carbon fiber, natural fiber bio-composites such as the flax-based composite material Ekoa, and resin treated sustainable wood and wood products, including finished birch plywood and finished high-density MDF. Drawer bottom 480 can be made from a variety of suitable water-resistant and/or antimicrobial materials including recycled/recyclable plastics, corrosion resistant metals and metal alloys, carbon fiber, natural fiber bio-composites such as the flax-based composite material Ekoa, and resin treated sustainable wood and wood products, including finished ½" birch plywood and finished high density MDF.

In some embodiments, the natural fiber components such as wood, or MDF of drawer 212 can be soaked with thinned bio-resin to ensure water proofing. CNC machining and/or injection molding, and/or vacuum molding can be used to ensure precision and consistency of the drawer components. Components may also be produced by laser cutting, and post-processing to remove scoring.

Figure 4A:
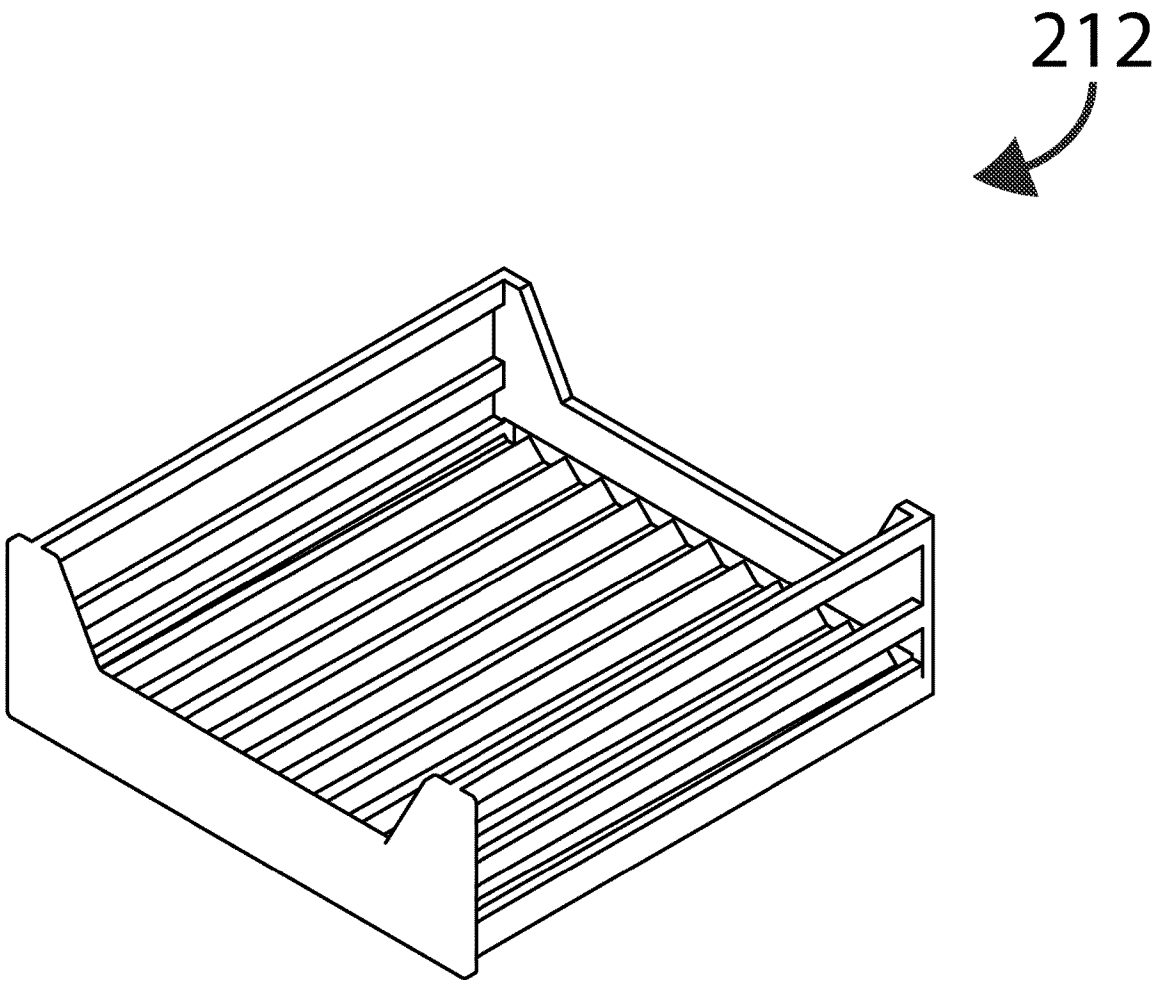
FIGS. 4A-4D are perspective views of one of the drawers of FIG. 3A.
Figure 4B:
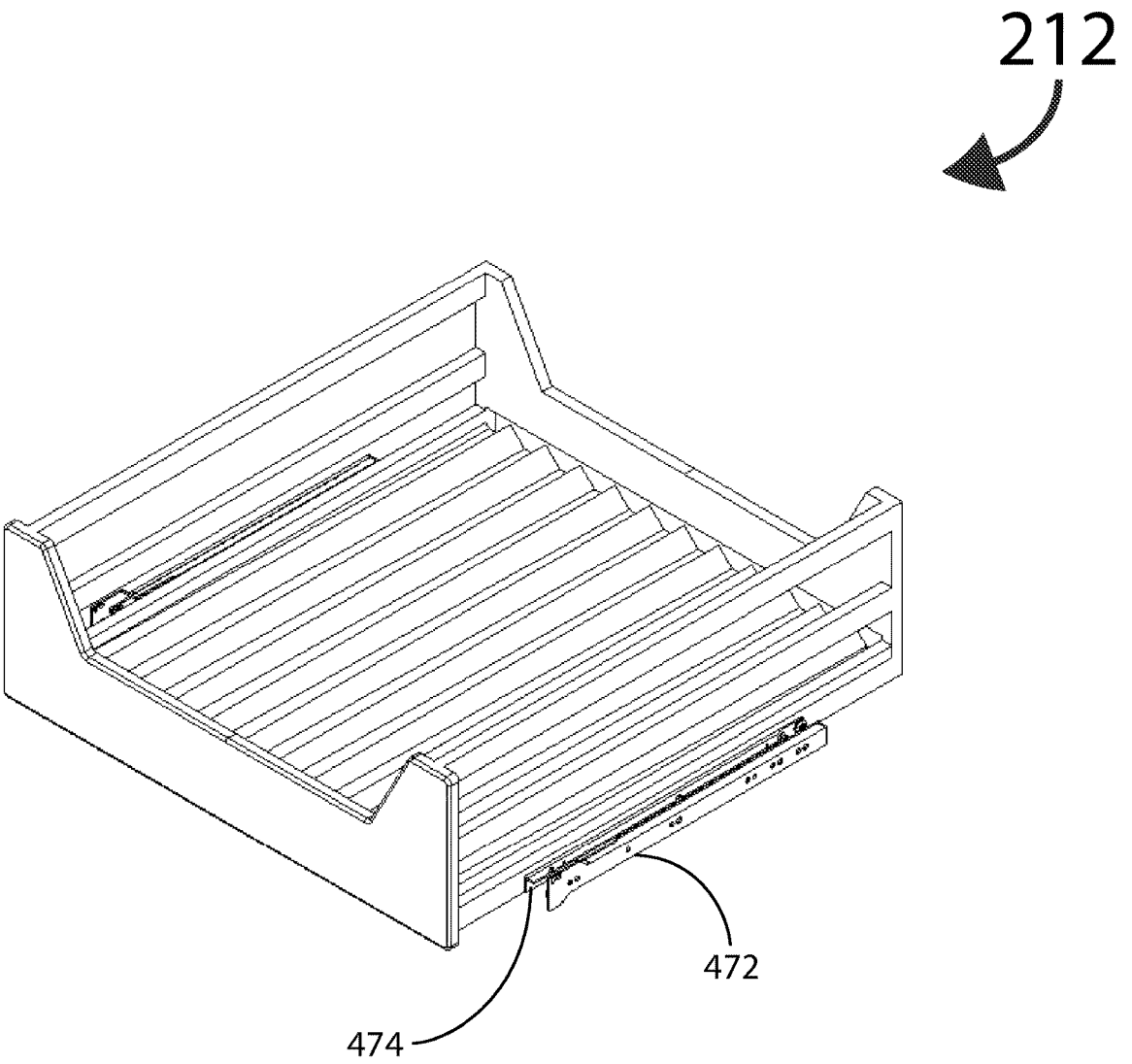
Figure 4C:
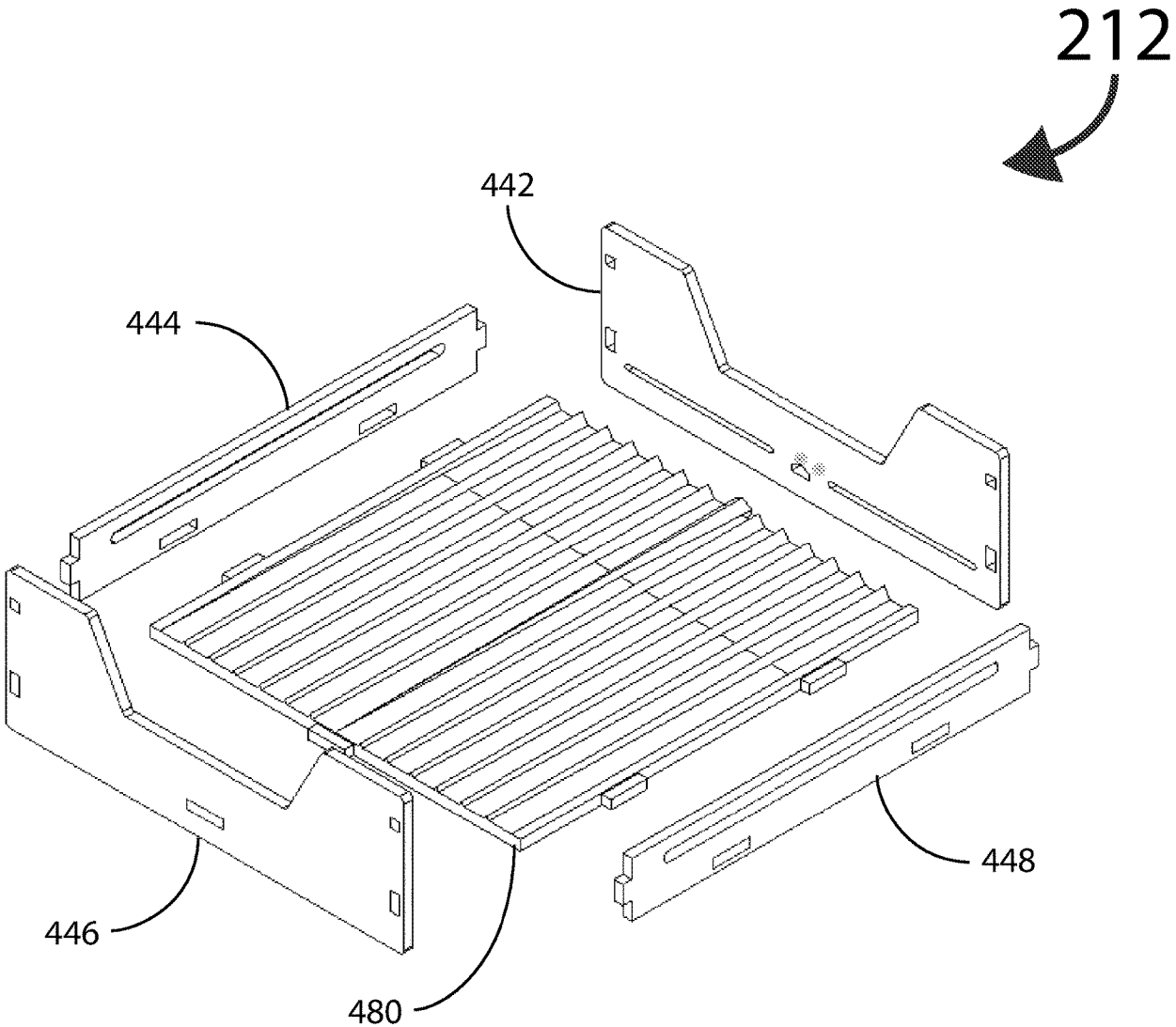
Figure 4D:
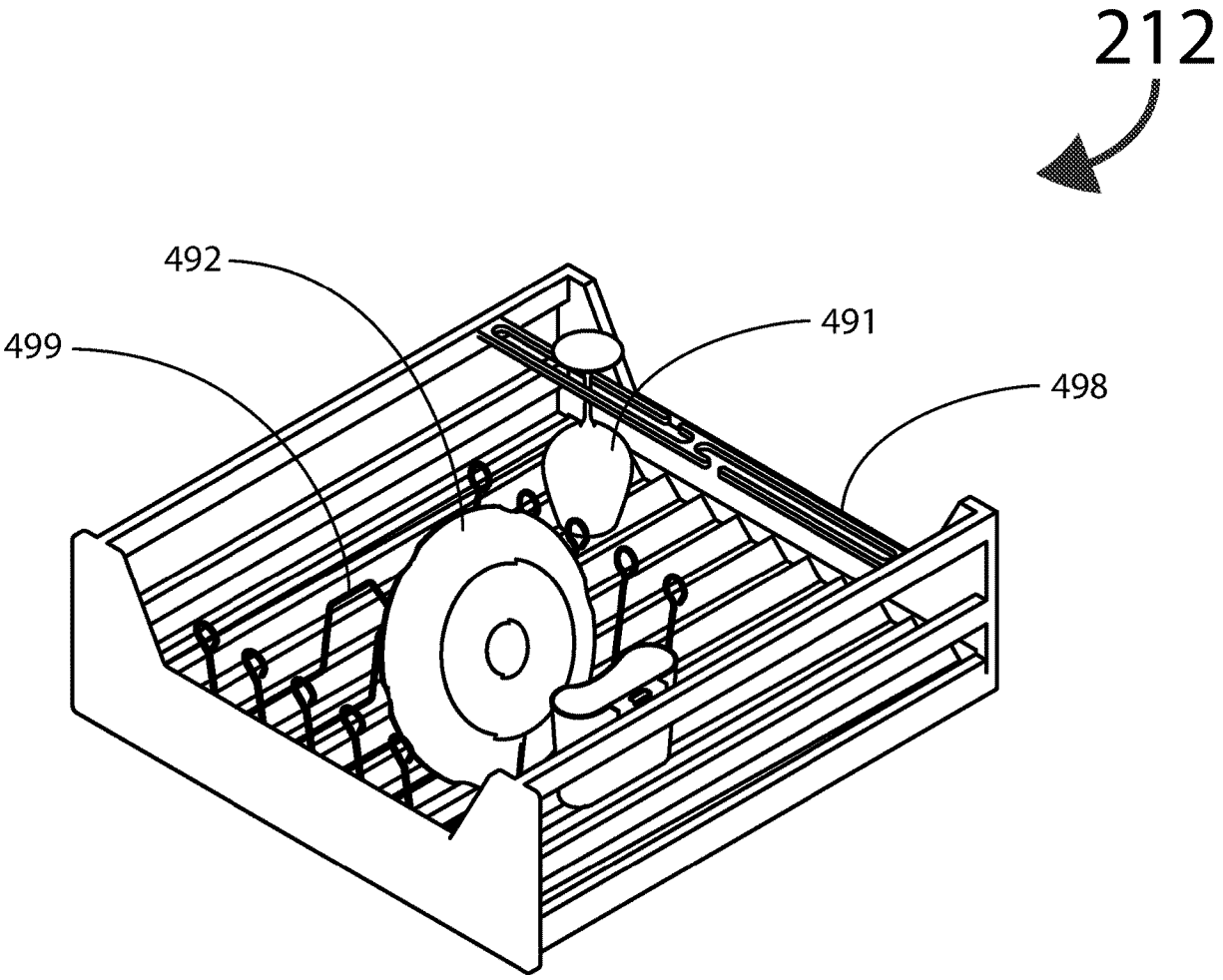

Bottom 480 also includes a plurality of sloping and tapering channels, e.g., corrugated channels 573 & 578, for gravity-draining (e.g., towards the rear) any excess moisture from cooking utensils, e.g., cooking pot(s) and/or pan(s), serving utensils such as bowl(s) and plate(s) 492, and drinking container(s) such as stemware 491 suspending from hanger 498 (see FIGS. 3C & 4D). Any water drained from drawer 212 can be optionally fed to a suitably-sized pump that can be routed to the home's grey water system (not shown).

In some embodiments, drawer 212 includes an evaporative layer such as microfiber mat 588 located between the optional utensil rack 499 and drawer tray bottom 480, and configured to moderate any dripping water from the drawer 212 and aid evaporative drying via air convection.

In other embodiments, the layer described in 0030 above may be formed from other wicking materials such as wool, or bio-composites such as those made from the shells of certain tree nuts, or plastics other than those currently used in microfiber drying mats.

Figure 6:
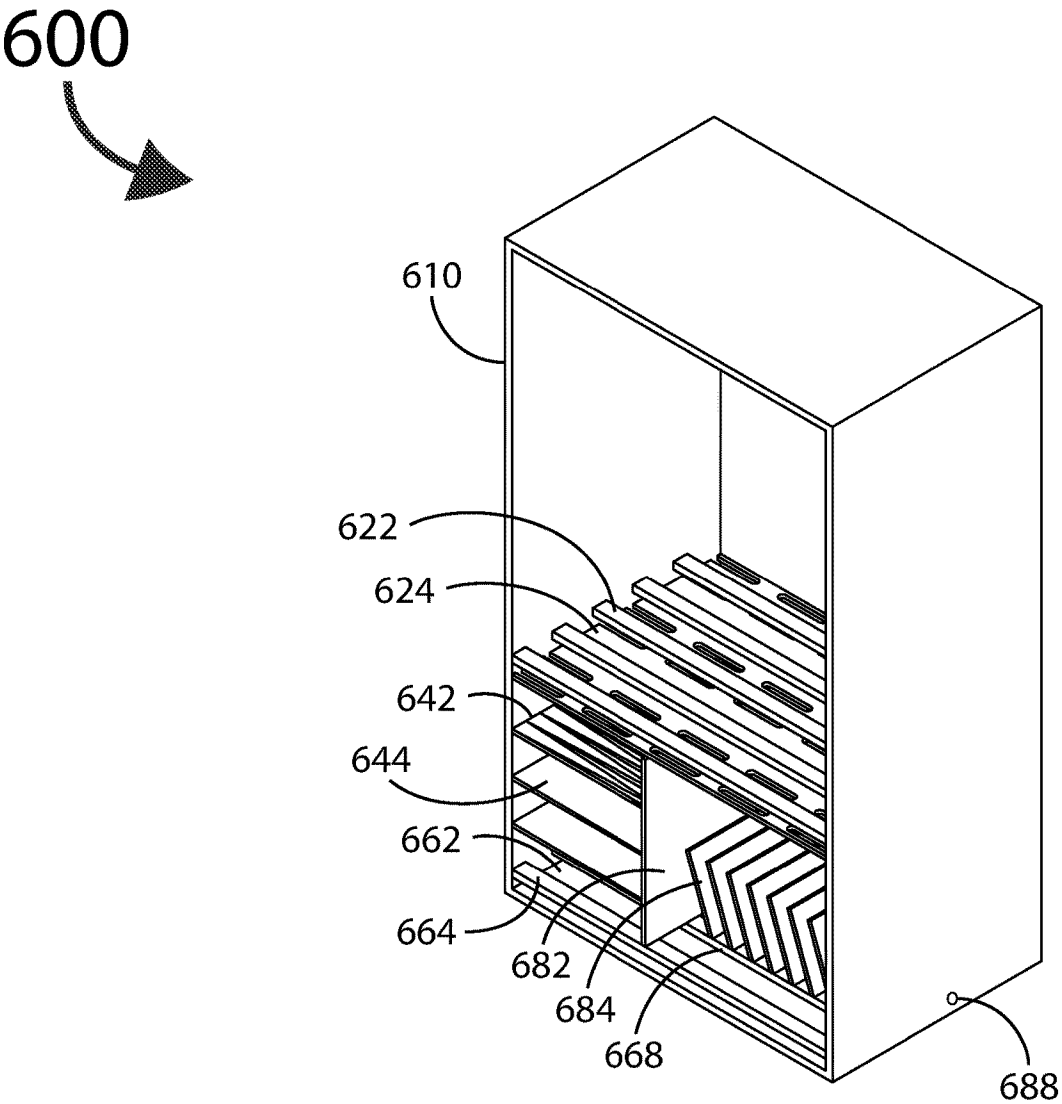
FIG. 6 is a perspective view of an exemplary upper drying/storage space for the collaborative culinary workspace of FIG. 2.

FIG. 6 is a perspective view of an exemplary upper drying/storage space 600 for configuring the drying/storage space 232 of collaborative culinary workspace 111. In this embodiment, space 600 includes a casing 610 a perforated shelf 624 with divider slats, e.g., slat 622, aerated shelves 642 & 644, a bottom shelf 662 with divider slats, e.g., slat 664, an additional vertical divider 682, utensil separators, e.g., separator 684, and an optional drainage port 688.

Figure 7A:
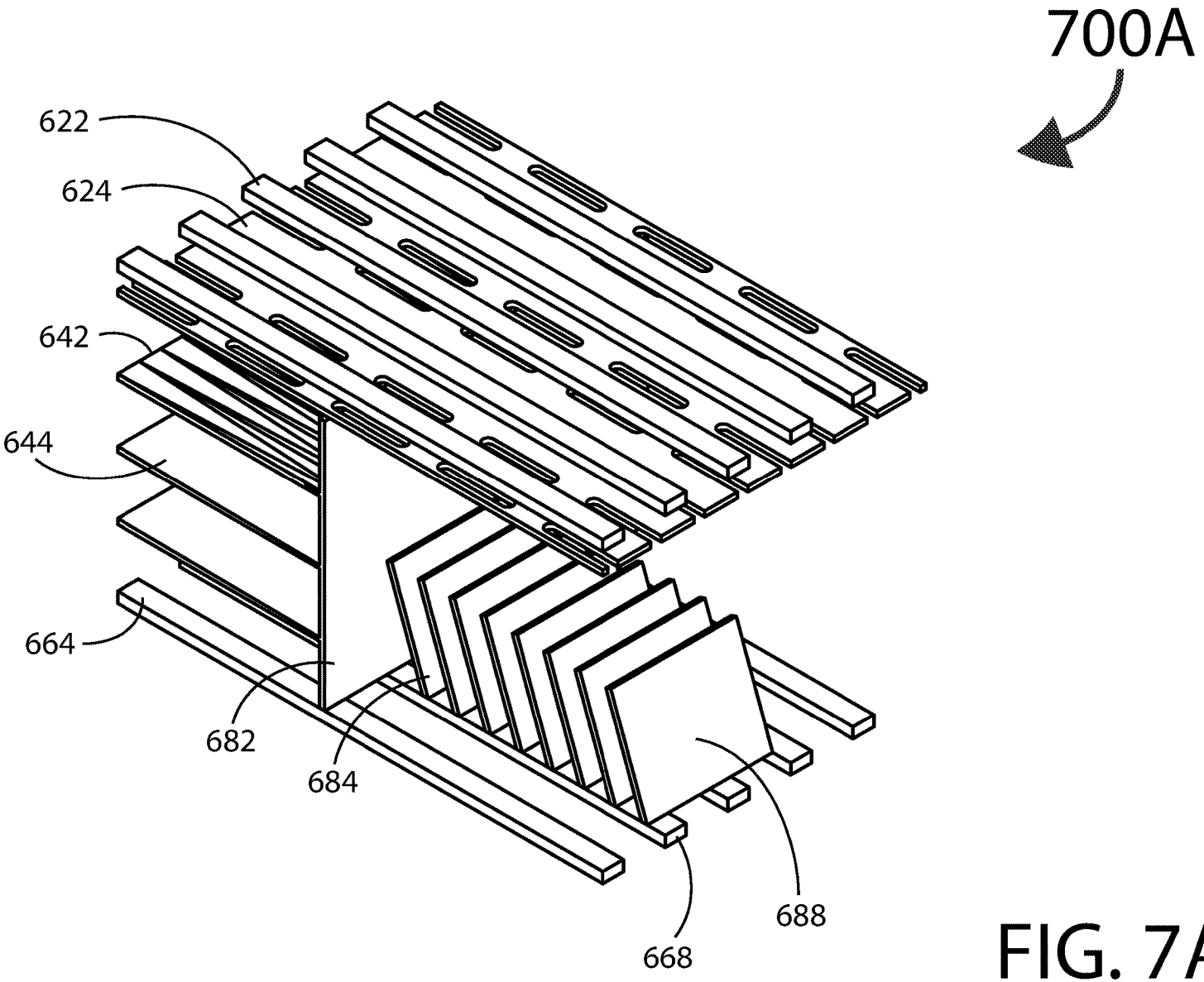
FIGS. 7A-7E illustrate sub-component combinations for the upper drying/storage space of FIG. 6.
Figure 7B:
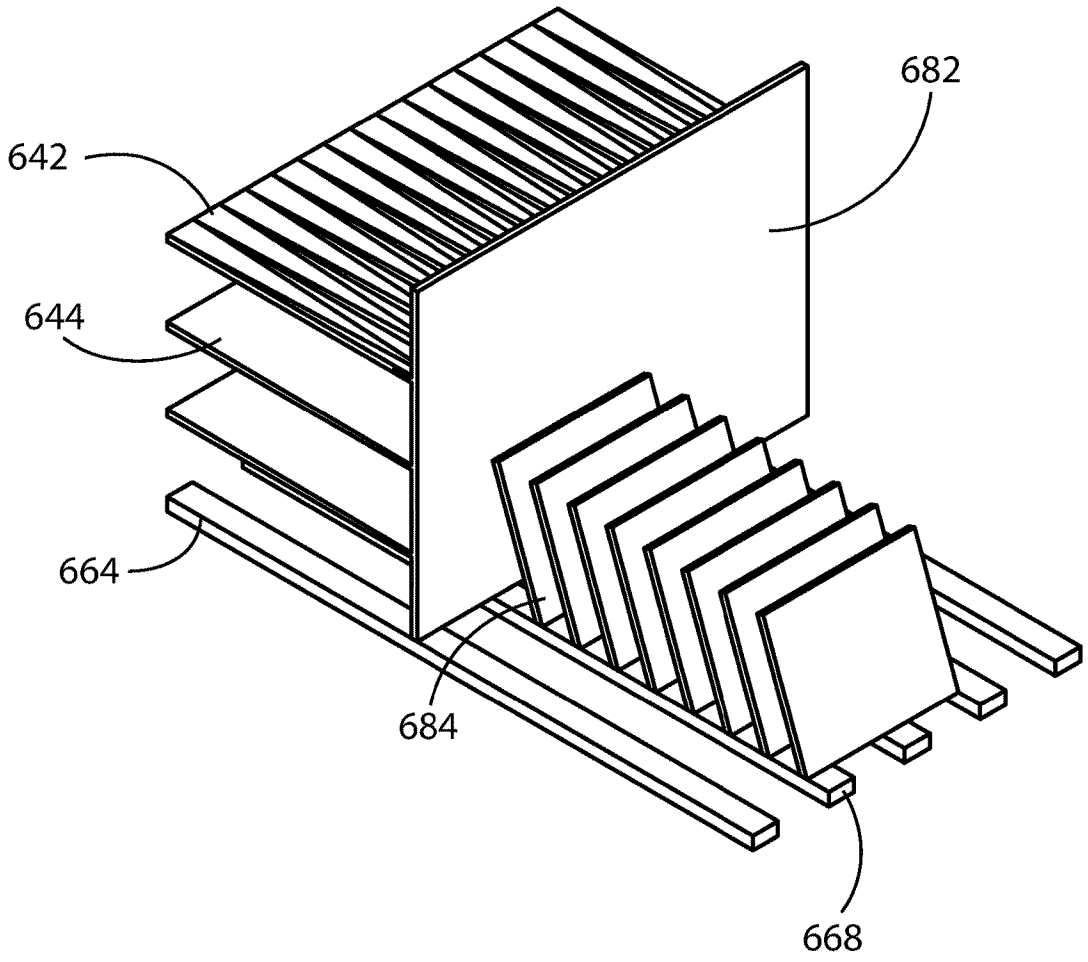
Figure 7C:
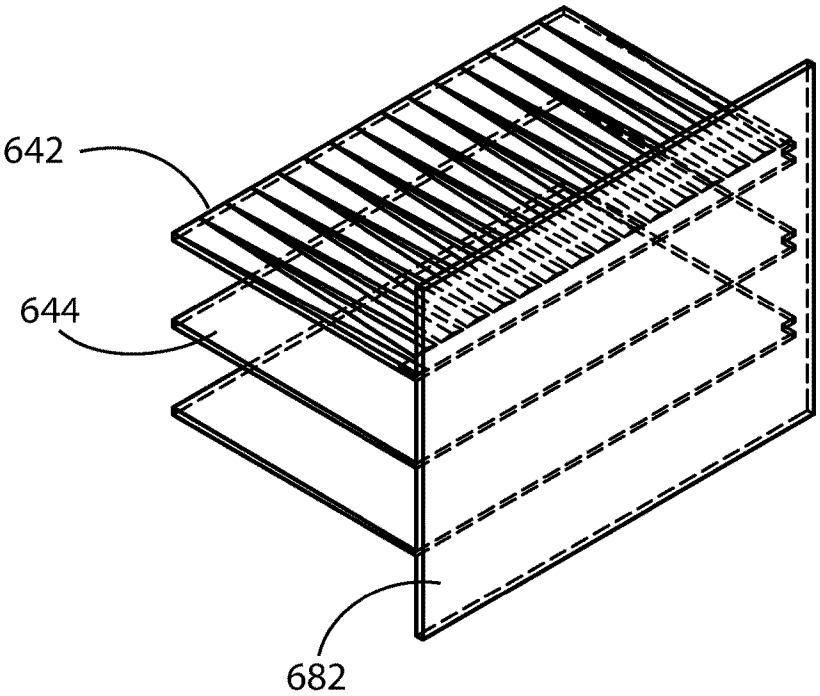

Referring also to FIGS. 7A-7E illustrating exemplary sub-component components for the upper drying/storage space 600, FIG. 7A depicts a close up view 700A showing perforated shelf 624 with divider slat 622, aerated shelves 642 & 644, divider slats 664 & 668, vertical divider 682, and utensil separators 684 & 688. FIGS. 7B & 7C are more detailed views 700B & 700C further illustrating sub-components shown in FIG. 7A.

Figure 7D:
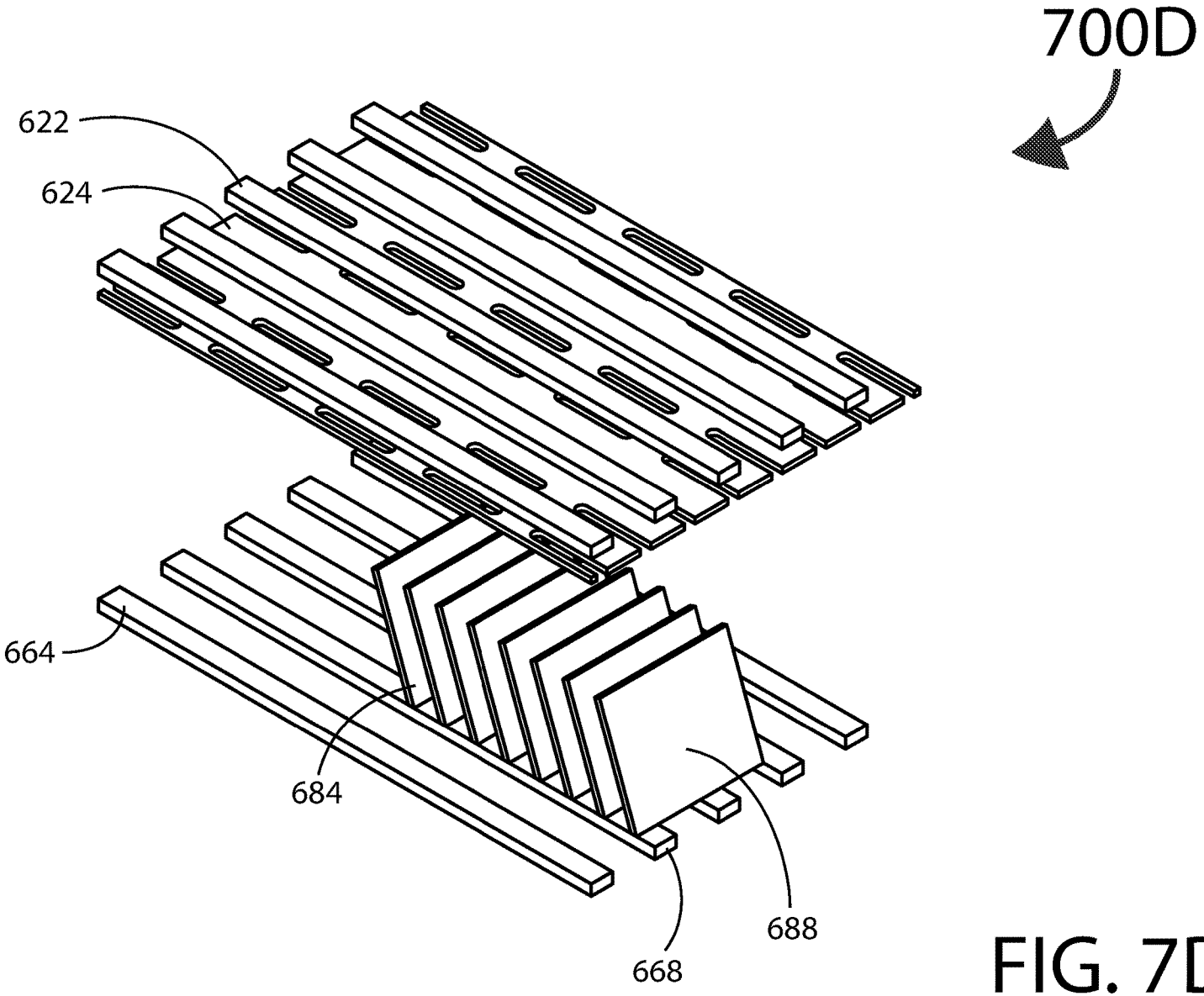
Figure 7E:
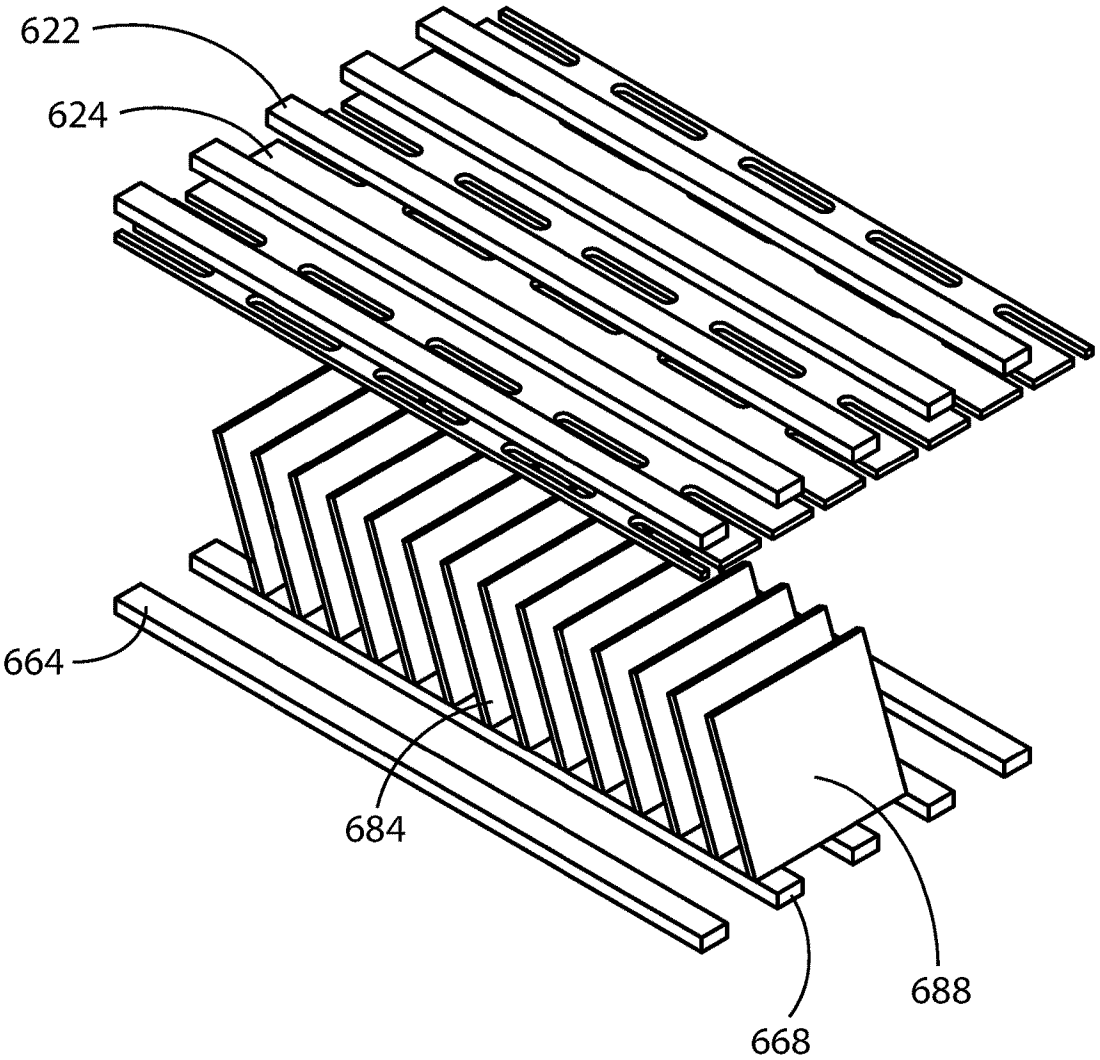

FIGS. 7D & 7E are perspective views 700D & 700E depicting alternative sub-component configurations for the upper drying/storage 600 of FIG. 6. Note that the configuration depicted in views 700D & 700E do not include the additional vertical divider shown in views 700A-C.

Figure 8:
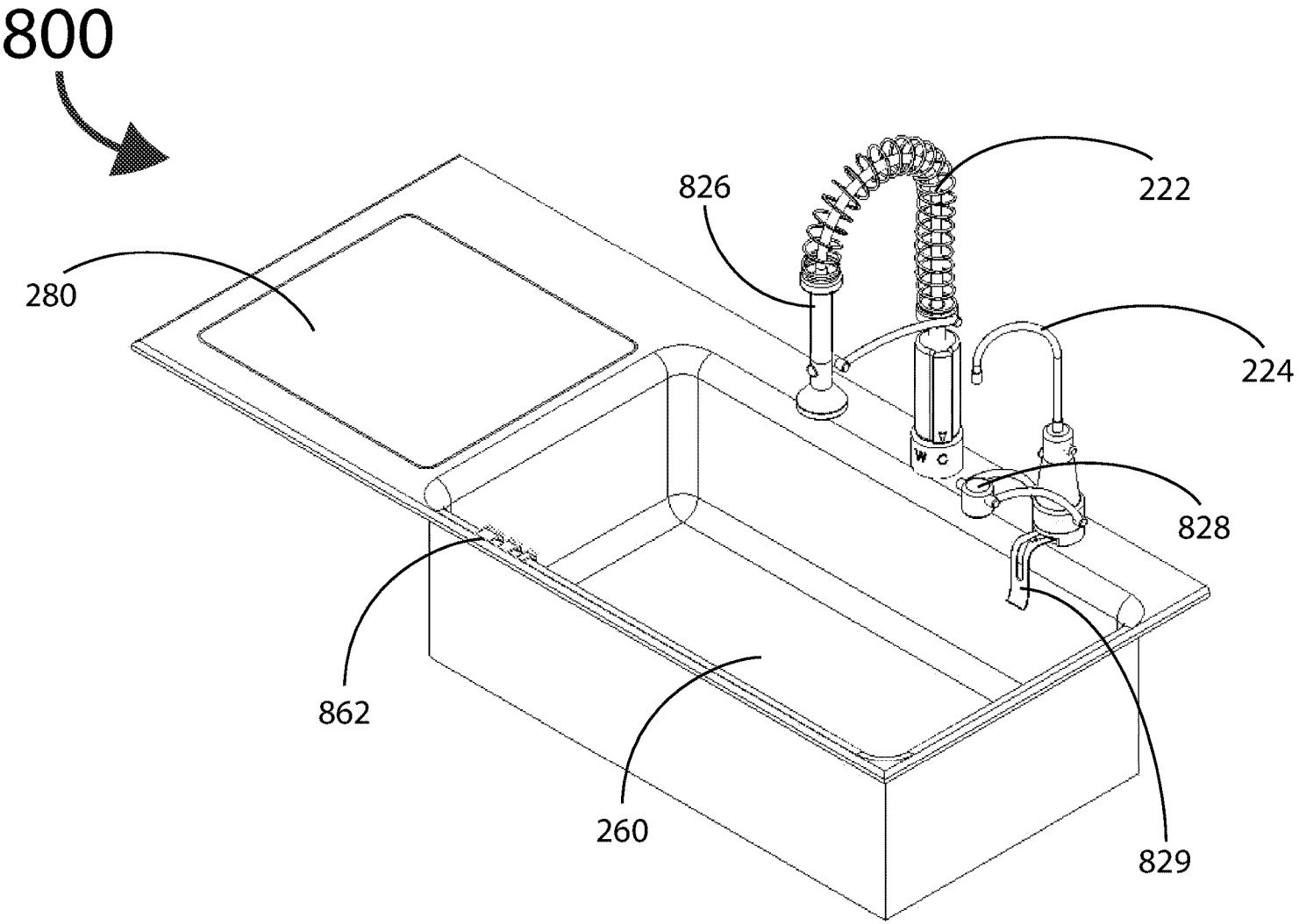
FIG. 8 is a perspective view showing one embodiment of water management station for the CCW of FIG. 2.

FIG. 8 is an isometric view showing one embodiment of water management station 800 for CC workspace 111. Exemplary station 800 includes a primary washing/rinsing device 222 (with a nozzle head 826) operatively coupled to a water flow controller 862, a secondary high-flow pot-filling device 828 coupled to a filtered water dispenser 224, a water flow control paddle 829, a washing/rinsing basin 260, and a food preparation/counter control platform 280.

Figure 9:
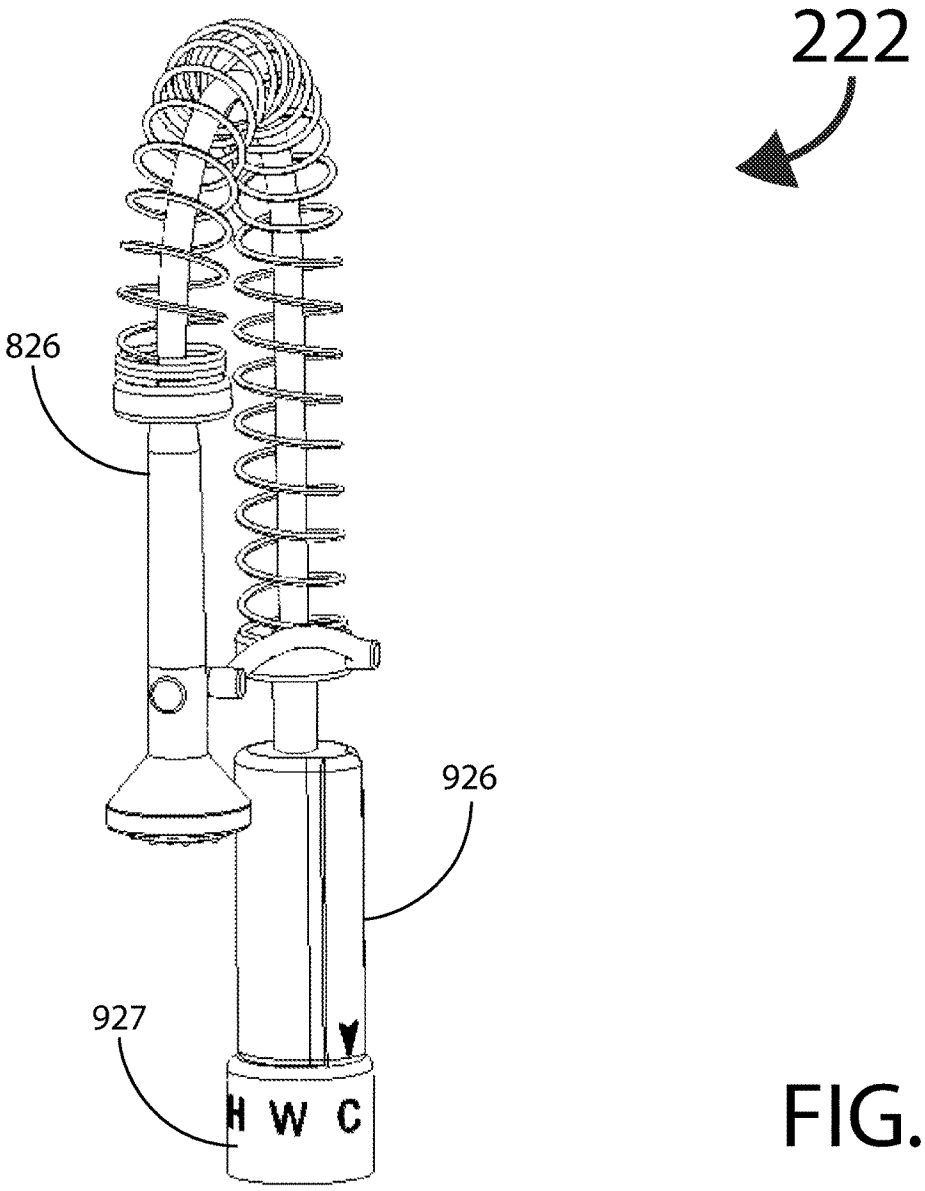
FIGS. 9 and 10 illustrate an exemplary primary washing/rinsing device for the water management system of FIG. 8.
Figure 10:
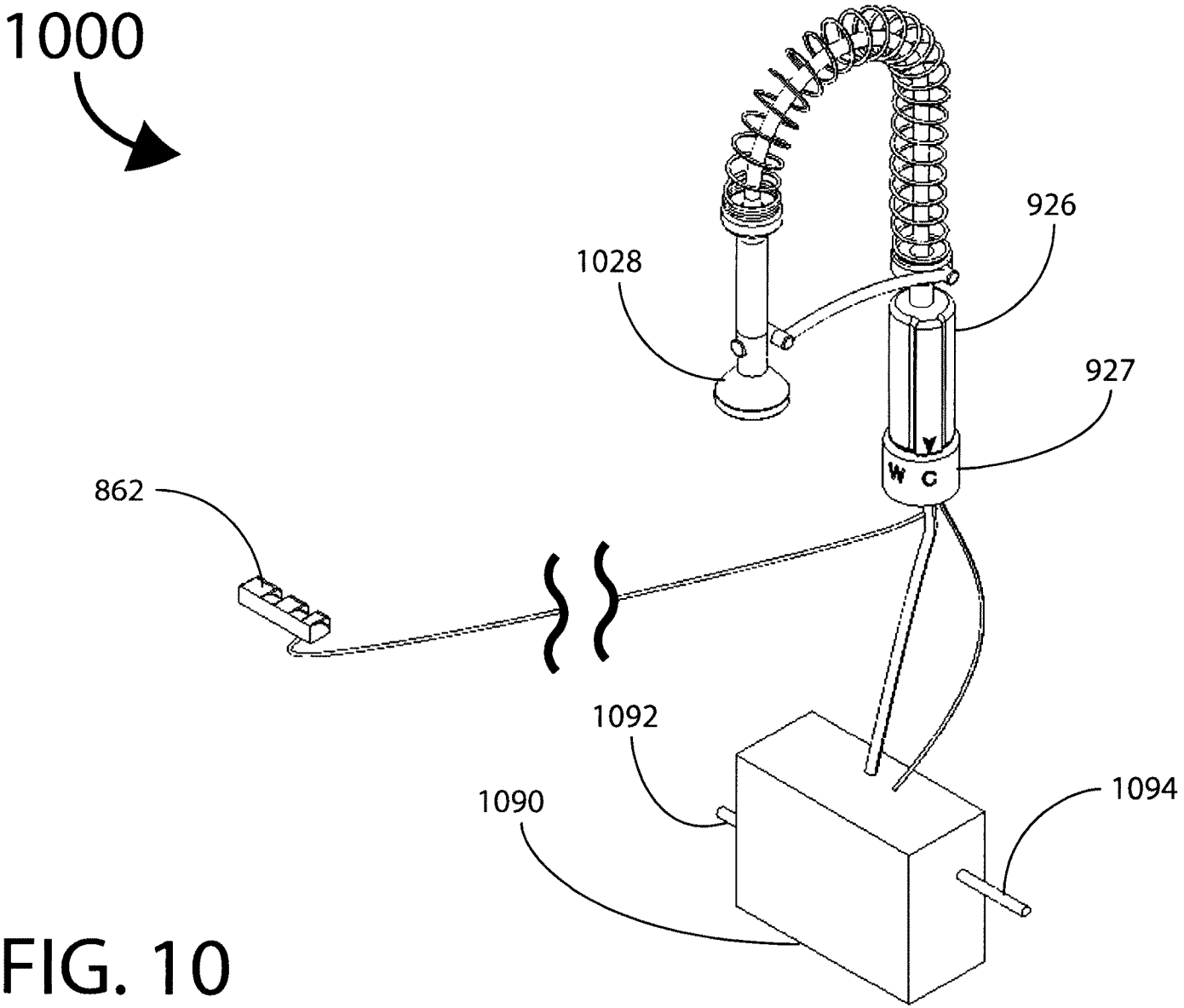

FIGS. 9 and 10 further illustrate an exemplary primary washing/rinsing device 222 which includes an indexed temperature selector 927 and a spray-first faucet nozzle 1028 preset to provide an environmentally-friendly low-flow spray by default. Selector 927 can be used to control the water temperature, e.g., Cold, Warm and Hot, which temperatures are pre-set by the user according to personal preference. The water temperature of device 900 can be displayed by backlighting the selector 927.

In some embodiments, primary washing/rinsing device 222 is operatively coupled to and controlled by a control unit 1090. Water temperature of device 222 can also be set via dial 926, and flow rate can be set via buttons 862. Control unit 1090 includes mechanical or servo-controlled valves that adjust the respective flow of hot water feed 1092 and cold water feed 1094 to accomplish the requested water temperature. Communication channels of control unit 1090 can be wired, wireless, optical and/or mechanical. In addition, resident(s) can remotely monitor and/or control device 222 via for example smart phones and/or smart assistant(s) such as Amazon Alexa, Google Nest.

Figure 11A:
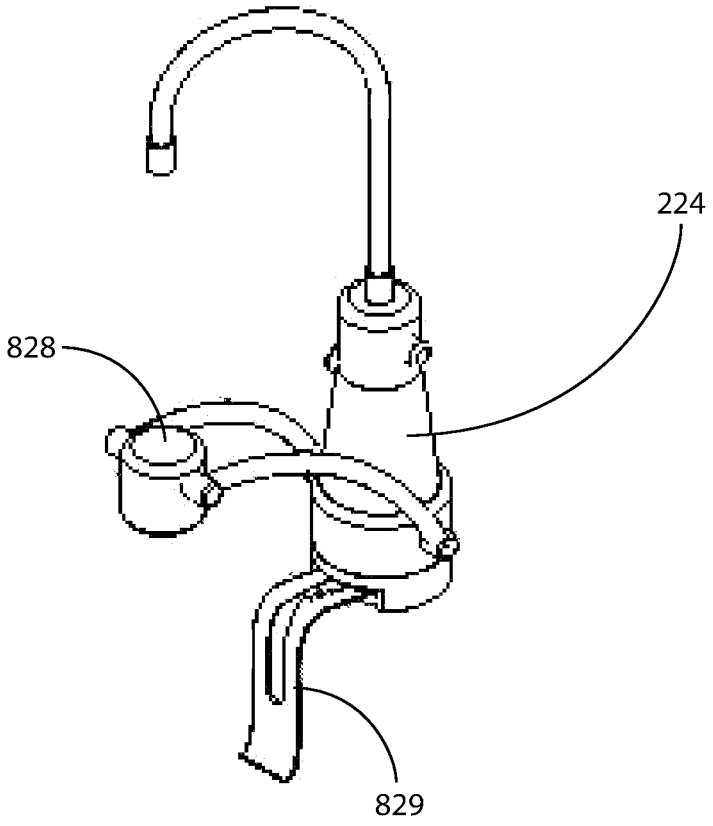
FIGS. 11A and 11B illustrate an exemplary filling device coupled to a filtered water dispenser for the water management system of FIG. 8.
Figure 11B:
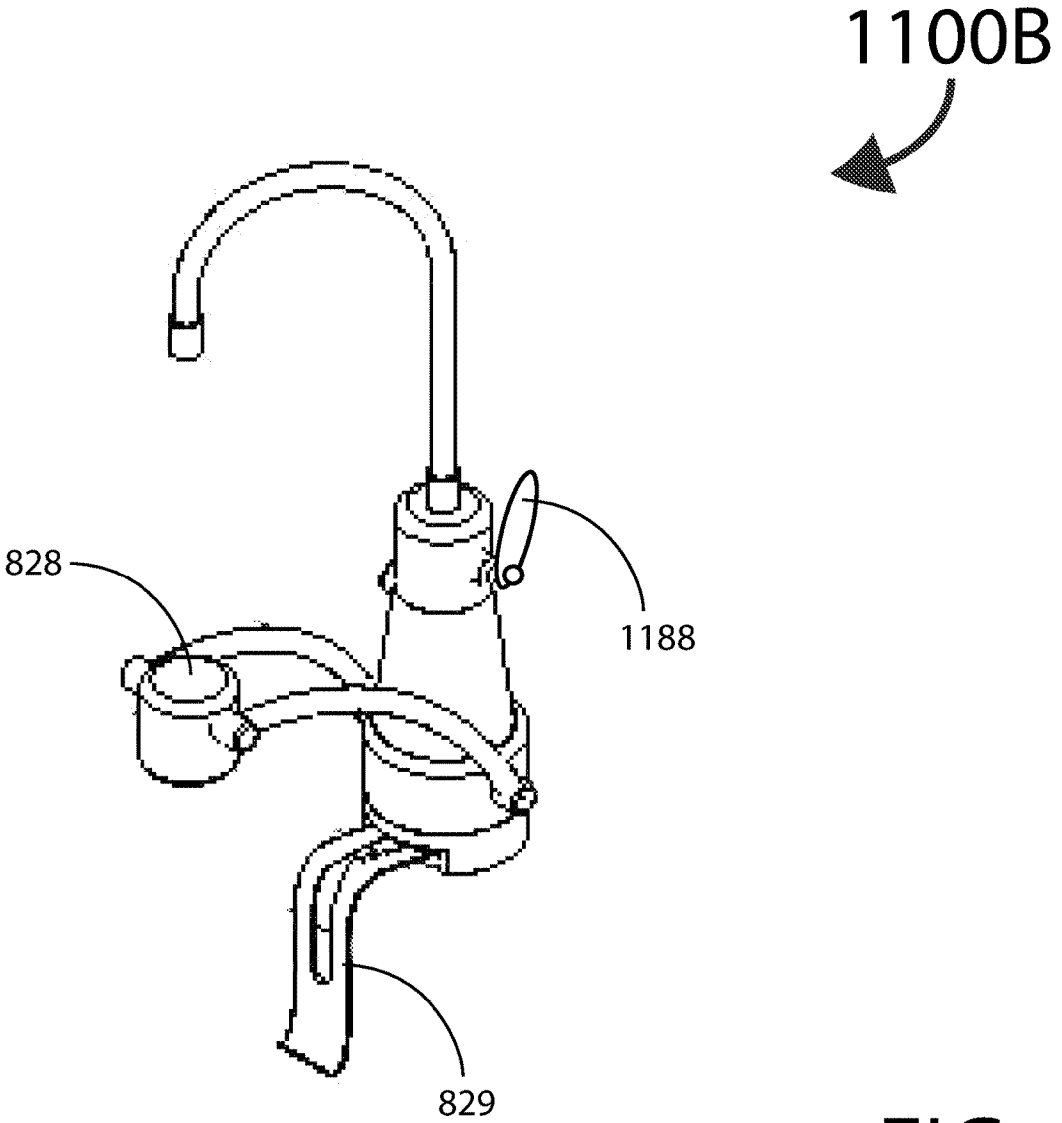

In some embodiments, as illustrated by FIG. 11A, water management system 800 also includes a secondary high-flow filling device 828 coupled to a filtered water dispenser 224 thereby complementing the capability of station 800. In some embodiments, the high-flow filling device 828 is not coupled to a filtered water dispenser 224. FIG. 11B includes an ADA-compliant lever 1188 for the water dispenser that is easier for a disabled person to operate.

Figure 12:
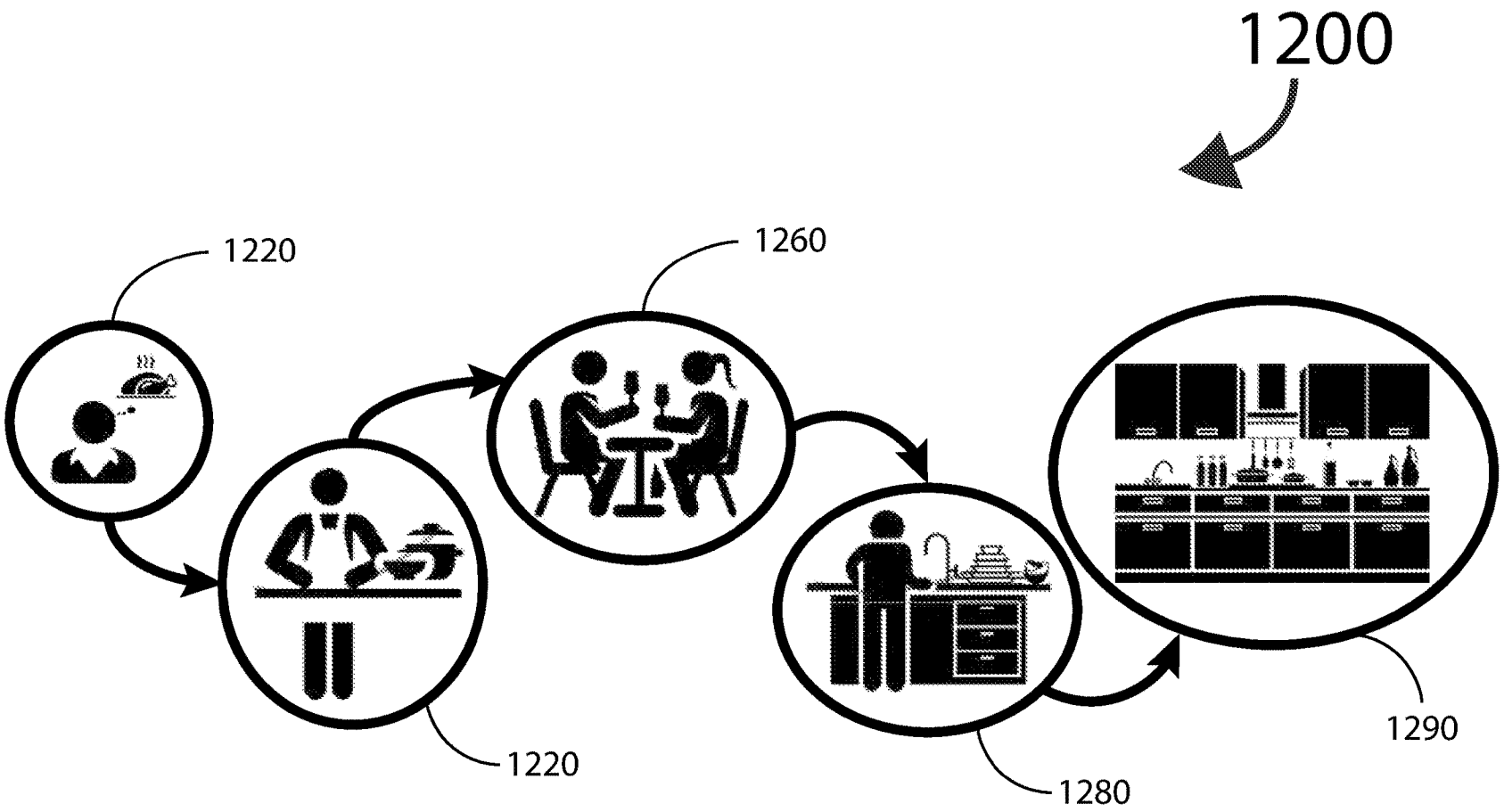
FIG. 12 idealizes an exemplary environmentally-friendly, space-optimized and efficient food preparation cycle journey map in accordance with the present invention.

FIG. 12 is a flow diagram 1200 idealizing an exemplary streamed-lined environmentally-friendly and space-optimized food preparation cycle journey map of multiple co-residents of CC workspace 111 in accordance with the present invention. Co-residents can now optimally and collaboratively plan (step 1220), prepare (step 1240), dine (step 1260), wash (step 1280) and dry/store (step 1290), together and/or separately, simultaneously and/or consecutively, just like professional musicians of an orchestra playing in synchronous harmony.

As a result, co-residents can be shifted up to show that the transition from thinking of cooking to beginning the actions for cooking is no longer an immediate drop into dissatisfaction with the dish cycle. Now, instead of encountering clutter and unavailability, they have the experience of finding what they need, and in a condition and place they are comfortable with. Further, when the co-residents finish their meal and clean up, they can leave the kitchen feeling satisfied that they have achieved a level of control that enabled them to manage their shared CC workspace 111 responsibly.

Figure 13:
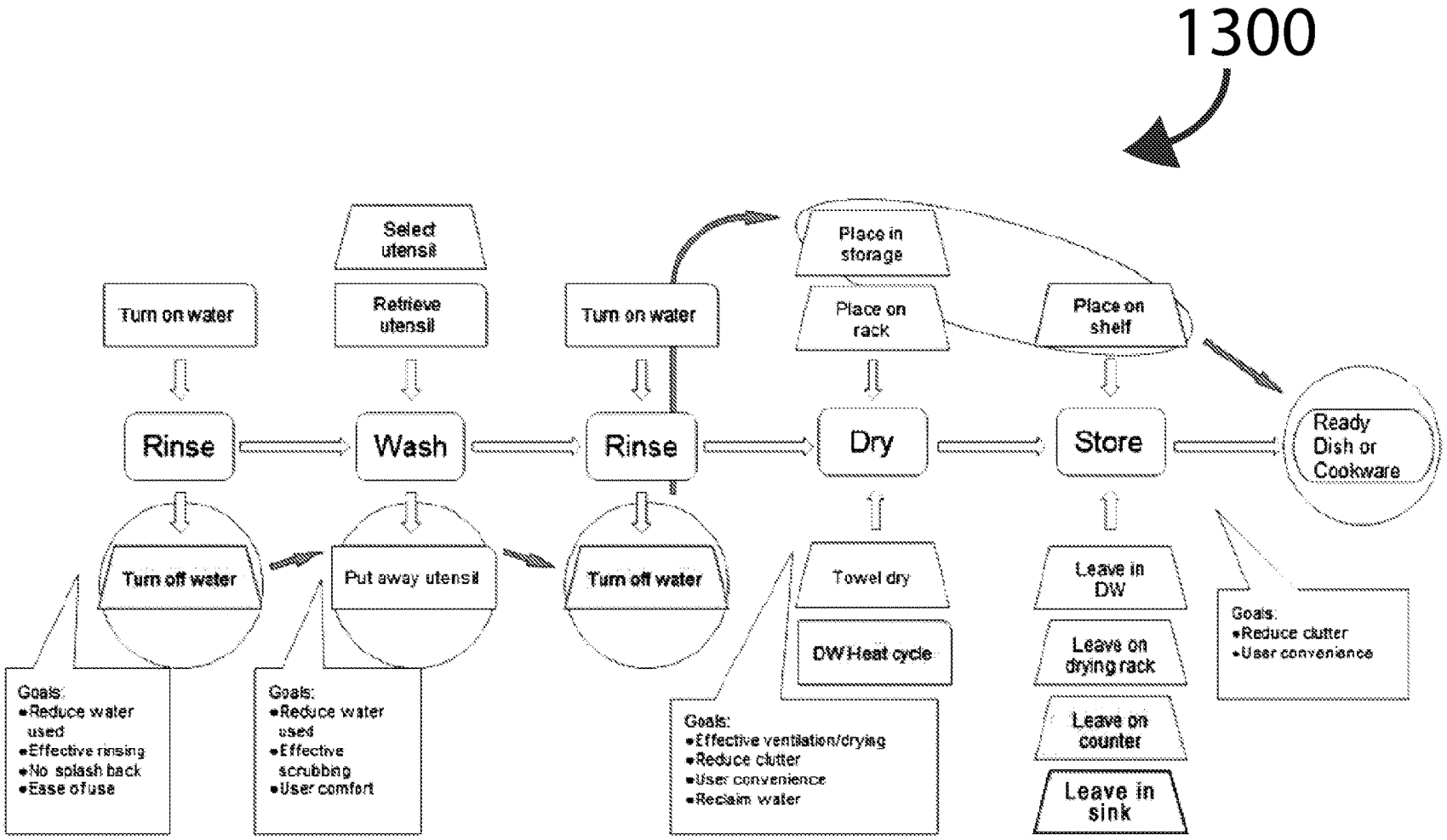
FIG. 13 is an exemplary morphology map breaking the dishwashing experience of a co-resident down into its key elements, and understanding the goals and steps/potential steps taken to achieve the co-resident goals in accordance with the present invention.

FIG. 13 is an exemplary morphology map 1300 breaking the dishwashing process of a co-resident down into its key elements, and understanding the goals and steps/potential steps taken to achieve the co-resident goals in accordance with the present invention. It is important to note that the ultimate goals of this process are to have clean and dry dishes which are ready for the next user of the communal culinary workspace 111. Through FIG. 13 it is possible to draw a path connecting and therefore demonstrating the most efficient choices among the potential steps. Although the use of water is necessary for the rinse-wash-rinse part of the process, there is the potential choice of stopping or reducing the continuous flow of water from sub-step to sub-step. Consequently, the above described novel methods reduces the time that water is flowing, the effort required to run and stop the water, and the flow of the water when running.

Likewise, it is possible to see and connect potential options that reduce clutter, and create efficiency and availability of items by combining the drying and storage steps at their highest level. In other words, the most efficient ideal is to be able to dry dishes and cookware in their final storage locations, with the next most efficient ideal being to dry them in a semi-final location that is off the counter, but not inconveniently secured inside a dishwasher where they are unavailable to the next user for the period of time needed for the dishwasher's cycle, which could be a matter of hours, or to otherwise remove them from total view where the next user will spend unnecessary time and effort trying to locate them.

Many modifications and additions to the embodiment of CC workspace 111 described above are contemplated in accordance with the present invention. For example, a forced-air heating regulator of an existing HVAC system can be strategically located proximate to drawers 212, 213, 214, 215, 216 & 217 to speed up the drying process; A suitably-sized fan can be placed low in the drawer cabinet to circulate warm dry air down to displace cool wet air that settles to the bottom of the cabinet; Heat can be captured from the hot water plumbing and conducted to the drying cabinet. Optional heating coils (electrical or fluid) embedded in the above described shelves/drawers are also possible. A dehumidifier may also be incorporated in the above described CCW.

Referring back to FIG. 1, it is contemplated that in the context of a Holistic Communal Culinary Ecosystem 100, one or more Collaborative Culinary Workspaces ("CCWs") can be coupled to one or more Communal Culinary Servers 150, CCW sensor(s)/monitor(s) 120, third party server(s) 170 and stakeholder communication devices 191, 192, 193 . . . 199, via a communications network 140, such as the Internet, cellular network, and/or telephony network. Stakeholder(s) of Ecosystem 100 can include the above described co-residents and culinary-related vendors including grocery provider(s) such as supermarkets & departmental stores, meal kit provider(s) such as Hello-Fresh & Blue-Apron, culinary equipment provider(s), CCW supplier(s), CCW installer(s) and/or repairer(s).

Communal Culinary Server(s) 150 can efficiently facilitate CCW sharing by scheduling cooking cycles, optimizing restocking cycles by allocating refrigeration and storage space, speedup overlapping food preparation such as cooking a large pot pasta to be shared by multiple residents, each preparing different individual pasta sauces. Server(s) 150 can also enable co-residents to share supplies such as paper towels, condiments, sauces and cooking oil by tracking usage and automatically/efficiently initiating ordering & reordering (by individuals or residential-groups), thereby further optimizing the shared storage spaces of the CCW, lowering the overall cost of supplies, and potentially reducing shipping costs by order consolidation (environmentally friendly).

In some embodiments, Server(s) 150 can adapt to specific co-residents' preferences over time using AI algorithms. Server(s) 150 can recommend recipes to co-residents based on these preferences and order the ingredients automatically from the above mentioned vendor(s).

CCW Sensor(s)/Monitor(s) 120 can include thermometer(s), humidity sensor(s) & camera(s) enabling the co-resident(s) to better control the drying environment of the CCWs, by for example, increasing or decreasing the temperature and/or airspeed of a dedicated CCW fan described above or the HAVC system via a smart thermostat.

Third Party Server(s) 170 can include lodging matcher(s) such as Airbnb and Expedia and Realtor.com, apartments.com, to facilitate matching of co-residents, taking into consideration food preferences as influenced by, for example, preferred diets such as Mediterranean, vegetarian, Keto & vegan, religious food preparation practices such as Kosher & Halal, and/or the co-residents' palates & allergies.

Other Server(s) 170 can facilitate personal chef service(s), and/or cleaning service(s) Merrymaids & Mollymaid and/or takeout-food delivery service(s) such as Grubhub & DoorDash; either by individual residents or by residential-groups to save costs.

Accordingly, communication network 140 enable co-residents, generally with very busy professional and personal schedules, to cooperatively, seamlessly and efficiently plan/navigate their food preparation and washing cycles in their respective CCWs, thereby substantially increasing the longevity, viability and satisfaction of their cohabiting experiences.

Advantages of the present invention include eliminating the need for an automatic dishwashing machine, which is inadequate for multiple cook-cycle homes because it tends to remove needed items from availability when certain members of a shared household need them for their cook-cycle. Enables residents to keep the kitchen counters clear of dish clutter that interferes with space for food preparation.

In sum, the present invention provides systems and methods for keeping tableware and cookware clear of kitchen counters without the use of a dishwashing machine, and methods for reducing the amounts of time and water necessary to cook and clean dishes and cookware. These systems and methods enable multiple independent users of a shared kitchen to manage their cookware and tableware such that cooking and cleaning are accomplished with minimal disruption or inconvenience to themselves or the other users of the shared kitchen, and with a more efficient use of water. (Appendix A further illustrates the novel design and construction philosophy of the present invention).

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. In addition, where claim limitations have been identified, for example, by a numeral or letter, they are not intended to imply any specific sequence.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. An off-counter tableware, cookware or utensil drying space comprising:

a plurality of drawers, each drawer configured to allow water to evaporate off tableware, cookware or utensil which have been cleaned and placed in the drawer wet and a means of conducting that water which does not evaporate to a collection point which allows for the drainage or reclamation of the water in a manner that prevents residential water damage;

a plurality of shelves, each shelf configured to allow water to evaporate off tableware, cookware or utensil which have been cleaned and placed on the shelf wet and to conduct water which does not evaporate to a collection point which allows for the drainage or reclamation of the water in a manner that prevents residential water damage; and wherein the drying drawers or shelves are incorporated with an automatic dishwasher that is modified to share cabinet space with the drying drawers or shelves.

2. The drying space of claim 1 further comprising an enclosure for preventing the water damage.

3. The drying space of claim 1 further comprising a drainage port for directing water to a pump or other method for delivering the water to either the plumbing system of the home, or to a water reclamation system.

4. The drying space of claim 1 further comprising a wicking mat.

5. The drying space of claim 4 wherein the wicking mat is a microfiber mat.

6. The drying space of claim 1 wherein the plurality of drawers are operatively coupled to a forced air flow to speed up drying.

7. The drying space of claim 6 wherein the forced airflow includes airflow from a separate HVAC system.

8. The drying space of claim 1 further comprising a dehumidifier to speed up drying.

* * * * *